United States Patent [19]

Zecman

[11] Patent Number: 4,635,851

[45] Date of Patent: Jan. 13, 1987

[54] CASTING NOZZLE

[75] Inventor: Kenneth P. Zecman, Redford, Mich.

[73] Assignee: Pegasus Industries, Inc., Redford, Mich.

[21] Appl. No.: 630,731

[22] Filed: Jul. 13, 1984

Related U.S. Application Data

[63] Continuation-in-part of Ser. No. 533,409, Sep. 19, 1983, abandoned, which is a continuation-in-part of Ser. No. 483,869, Apr. 11, 1983, abandoned.

[51] Int. Cl.[4] ..... B05B 1/24

[52] U.S. Cl. ..... 239/133; 222/593; 239/135; 425/549

[58] Field of Search ..... 239/13, 132–135; 164/133, 144, 303, 312, 337, 338.1; 222/146 HE, 146.2, 592, 593; 219/424; 425/549; 264/328.15

[56] References Cited

U.S. PATENT DOCUMENTS

| | | | |
|---|---|---|---|
| 1,980,729 | 11/1934 | Loppacker | 219/424 X |
| 2,003,827 | 6/1935 | Esterling | 239/133 X |
| 2,878,359 | 3/1959 | Schreiner | 239/133 |
| 3,090,420 | 5/1963 | Sacco | 239/133 |
| 3,255,967 | 6/1966 | Kenney | 239/133 |
| 3,722,821 | 3/1973 | Jaeger et al. | 239/133 |
| 4,196,855 | 4/1980 | Osuna-Diaz | 239/135 |
| 4,262,820 | 4/1981 | Flint | 222/146.2 |
| 4,355,460 | 10/1982 | Gellert | 219/424 X |
| 4,557,685 | 12/1985 | Gellert | 239/135 X |

FOREIGN PATENT DOCUMENTS

| | | | |
|---|---|---|---|
| 62848 | 4/1982 | Japan | 222/593 |
| 2085777 | 5/1982 | United Kingdom | 164/303 |

*Primary Examiner*—Joseph F. Peters, Jr.
*Assistant Examiner*—Daniel R. Edelbrock
*Attorney, Agent, or Firm*—Krass & Young

[57] ABSTRACT

A nozzle for molten metal casting operations wherein is provided with an annular groove either in an exterior surface or, in the case of a nozzle having a hard metal insert, in an interior surface. In either case, the groove is filled with a material having a high heat conductivity and which is either in a location where it can receive heat directly from a localized source such as gas fired torch or in thermal circuit with such a location; i.e. connected to the location by some intermediate leg of high thermal conductivity material. In one specific embodiment the groove is filled with copper and is connected to a series of spiral extension grooves. In another embodiment is formed in an interior surface where it is adjacent a hard metal insert which increases the durability of the nozzle in repetitive make and break operations.

7 Claims, 9 Drawing Figures

CASTING NOZZLE

RELATED APPLICATION

This is a continuation in part of U.S. Ser. No. 533,409, filed Sept. 19, 1983, now abandoned, which is a continuation in part of U.S. Ser. No. 483,869, filed Apr. 11, 1983 now abandoned.

INTRODUCTION

This invention relates to apparatus for casting molten materials and particularly to a nozzle type conduit which is used to transfer the molten materials from a source to a mold.

BACKGROUND OF THE INVENTION

Casting operations involving molten materials such as zinc and zinc alloys are often carried out using a transfer conduit, commonly called "nozzle", which is trapped in a mechanical combination between a gooseneck spout and a mold or mold bushing. The nozzle is heated to prevent freezing of the molten material in the interior bore thereof, such heating being accomplished, for example, by a gas-fired torch which is trained upon a localized area of the nozzle. In order to maintain the body of the nozzle, typically made of steel, at a sufficiently high temperature to prevent freezing, the temperature of the locally heated area is necessarily very high. Several problems can result from this localized heating; one is the increased possibility of developing a hole from the through-bore to the exterior of the nozzle body due to rapid erosion of the nozzle body along grain boundaries. Since the molten material on the interior is under pressure, a potentially dangerous situation is produced by such holes from which high-pressure streams of molten material can be emitted. Another problem is the mechanical distortion of the nozzle body which can result due to the localized high heating and the compression forces that the nozzle must withstand when placed in the aforementioned combination with the spout and mold or mold bushing.

BRIEF SUMMARY OF THE INVENTION

In summary the present invention provides an improved casting nozzle adapted to be heated by a concentrated source, such as a torch or an electric cartridge heater, but designed to provide an even heat distribution throughout the nozzle body in order to prevent the freezing of the molten material which flows through the nozzle, to increase nozzle life and eliminate the problems associated with high-temperature localized heating of prior art devices. In general this is accomplished by providing a shallow groove pattern which extends circumferentially and axially over the nozzle body and which is filled with a material which has substantially greater heat conductivity coefficient than the nozzle body. The channel material is thermally connected as necessary to an area of the nozzle which receives heat from a localized source.

In one preferred form, the groove is formed as an annular band in the nozzle body and is connected to one or more spiral channels also filled with high-conductivity material and extending over the balance of the nozzle body.

DETAILED DESCRIPTION OF THE ILLUSTRATIVE EMBODIMENTS

Figure 1:
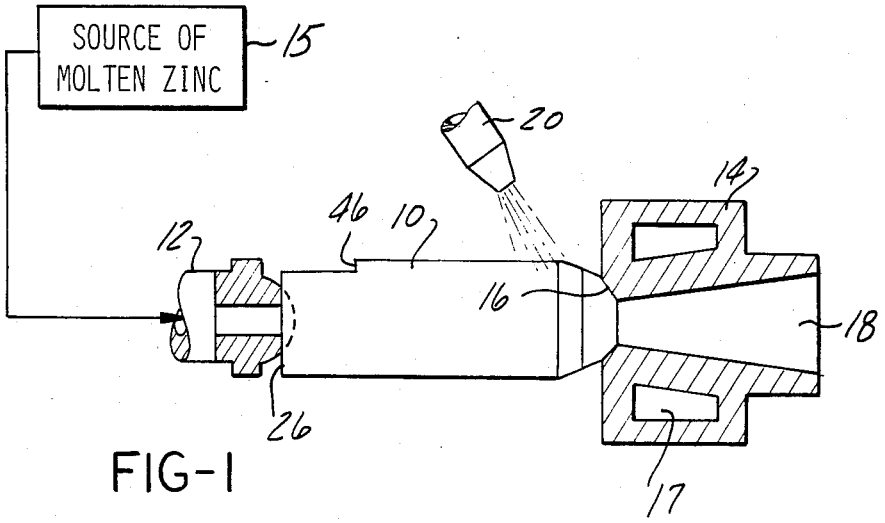
FIG. 1 is a sideview, partly in section, of a zinc die-casting apparatus having a first form of the nozzle located between a gooseneck and a die bushing.

Referring to the drawing, a nozzle 10 is illustrated in FIG. 1 connected between gooseneck 12 and die bushing 14. The gooseneck and the die bushing are conventional components of zinc die casting apparatus. The gooseneck is adapted to receive molten zinc from a source 15. The bushing 14 has a cooling water jacket 17 and a semi-spherical socket 16 for receiving the forward end of the nozzle for passing molten zinc into die opening 18, in the manner well known to those skilled in the art. Conventional gas-fired torch means 20 provides a flame located adjacent the forward end of the nozzle.

Figure 2:
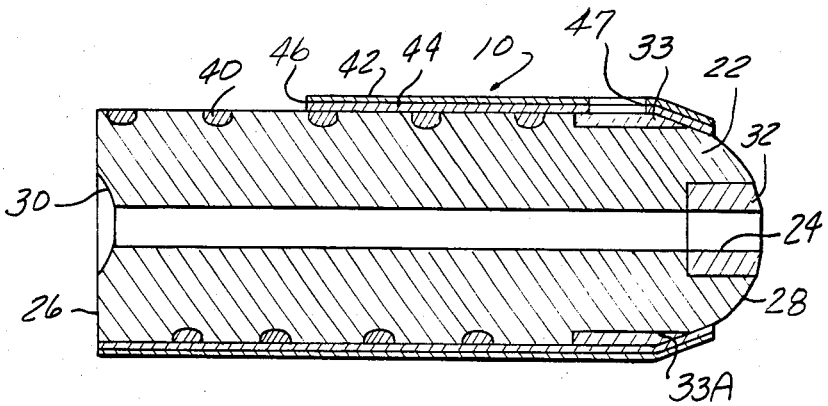
FIG. 2 is a longitudinal section through the nozzle of FIG. 1.
Figure 3:
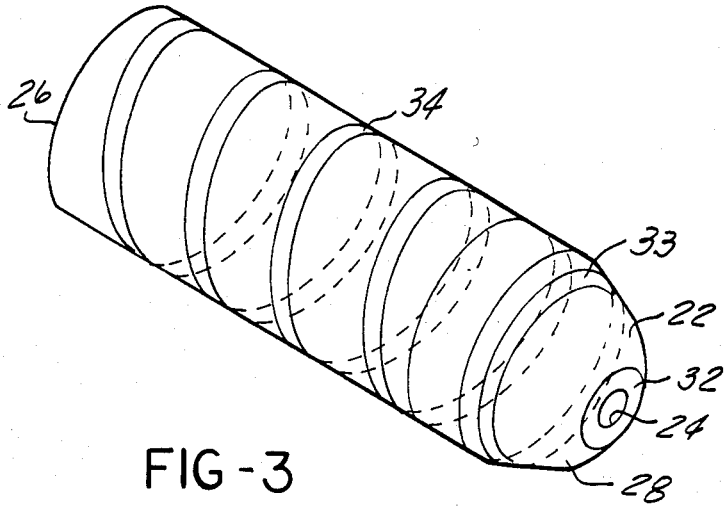
FIG. 3 is a perspective view of the nozzle of FIG. 1 with the jacket and insulation removed.

Referring to FIG. 2, the nozzle 10 has an elongated steel body 22 having a longitudinal opening 24 for passing molten zinc from the rearward inlet end 26 to the forward or outlet end 28. The rearward end has a semi-spherical socket 30 for mating with the gooseneck. It is to be understood that other forms of conventional nozzles have a ball-shaped rearward end for engaging a complementary structure on a gooseneck.

Forward end 28 has an insert 32 forming the nose of the nozzle. The insert is made of a material harder than the body of the nozzle to provide a long wearing engagement with socket 16 of the die bushing. The insert 32 may be considered optional.

Copper ring 33 is welded or brazed into the groove 33A adjacent the body nose. Nozzle body 22 has a helical groove 34 extending from ring 33, around the body, and toward the rear end of the body. The groove 34 and ring 33 are about ¼ inch deep and define intermediate land areas. The size and spacing between turns of the groove depends upon the length and diameter of the nozzle as well as the amount of zinc passing through longitudinal opening 24.

A core of copper 40 is welded or brazed into the groove 34 flush with the nozzle surface and does not extend depreciably onto the land areas; i.e., the land areas are left exposed. Copper is preferred because it has a greater heat conductivity than the steel body to form a heat-conducting path or channel so that the temperature of the nozzle along its length is relatively uniform.

Referring to FIG. 2, a stainless steel jacket 42 is mounted over the outer, cylindrical surface of the nozzle, and an insulating sleeve 44 is disposed between jacket 42 and the surface of body 22. Jacket 42 and sleeve 44 are cut out at 47 to expose the steel body to the heat of torch 20. The after end of sleeve 44 terminates at 46. The jacket 42 and sleeve 44 are optional elements; i.e., the device 10 may be used effectively without them.

Figure 4:
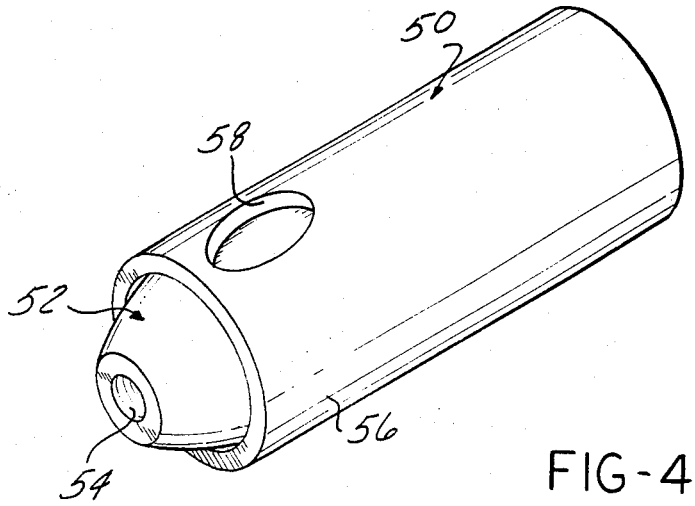
FIG. 4 is a prespective view of a second embodiment of the invention.
Figure 5:
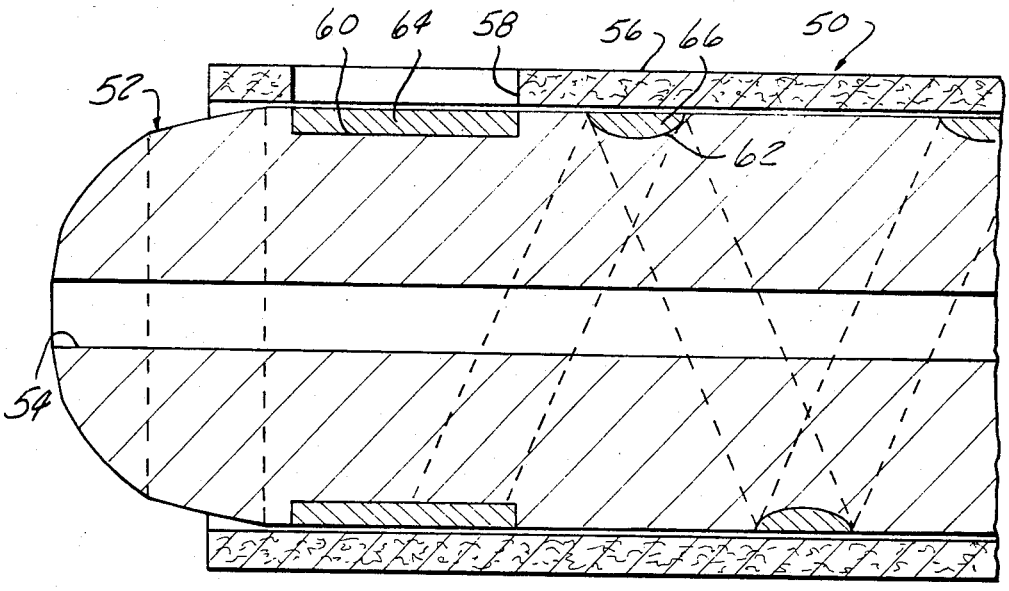
FIG. 5 is a sideview, in section, of the nozzle embodiment of FIG. 4.

Referring now to FIGS. 4 and 5 of the drawing, a second embodiment of the invention is shown to comprise a nozzle 50 comprising a steel body 52 having a spherical end adapted to fit into a mold bushing such as that shown at 14 in FIG. 1. Although not shown, the other end of nozzle 50 is configured, either concave or convex, to receive a source of molten metal under pressure. A longitudinal and axially centered bore 54 provides the passage for molten zinc and extends from one end of the body 52 to the other. The body 52 is optionally covered or jacketed with a cylindrical sleeve 56 of insulative material such as ceramic fiber. The fit is a relatively loose one around the nozzle body 52 and the jacket or sleeve 56 projects slightly forward of the taper and the body 52 to come as close to abutting the exterior surface of the bushing 14 as possible when placed into the arrangement illustrated in FIG. 1.

An oval shaped hole is cut or otherwise formed in the sleeve 56 to define the locally heated area, i.e., the area of the body 52 which is to receive the flame from the heating torch 20 when placed in the operative combination of FIG. 1.

The nozzle body 52 is machined to provide a wide groove extending circumferentially around the nozzle body in the area immediately under the opening or hole 58 in the sleeve 56 and further to provide a helical groove 62 which winds around the balance of the nozzle body as best illustrated in FIG. 5. As in the previous embodiment, the groove 62 defines land areas in the original nozzle body surface. The grooves, both the circumferential and helical portions thereof, are filled with copper by a welding or brazing operation so as to provide a wide band 64 of copper around the circumference of the nozzle body adjacent the nose or ball portion thereof and a helical band 66 which winds around the body toward the rearward end thereof. The location of the band 64 and the hole in the sleeve 56 may be varied along the length of the nozzle 50. The copper is flush with the land area surface and does not extend appreciably over the land surface.

In actual practice the nozzles to which the subject invention may be applied range from relatively small devices of about 1½ inches diameter by 6 inches in length to larger nozzles which are 3–4 inches in diameter and from 15–30 inches long. The copper band 64 in groove 60 is preferably on the order of about ¼ inch in depth, depending upon the diameter of the nozzle, and may vary in pitch or longitudinal distance between turns in accordance with the particular requirements of the application.

Figure 6:
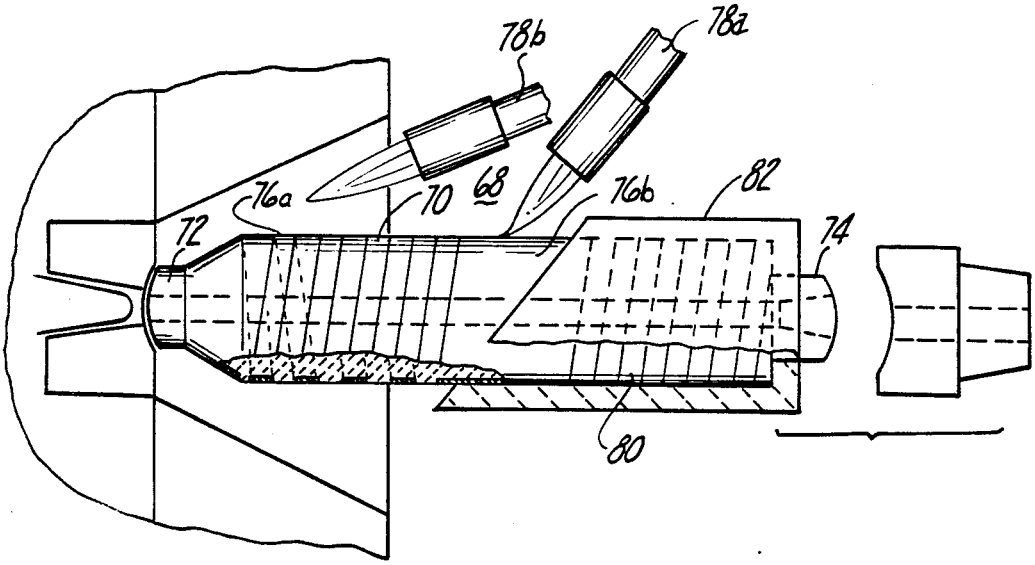
FIG. 6 is a sideview of the nozzle with the addition of an auxiliary "assist torch" and showing an alternative insulator to that of FIG. 4.

Referring to FIG. 6, an embodiment of the invention is shown of a nozzle 68 comprising a steel body 70 having a spherical end 72 adapted to fit into a mold bushing such as that shown at 14 in FIG. 1. Also shown is the convex other end 74 of nozzle 68 which receives a source of molten material under pressure. Two copper alloy bands **76*a* and 76*b*, are provided by forming channels in the nozzle body and then filling the channels with copper or a copper alloy. Band 76*a* is located near end 72 and 76*b* is located centrally around the nozzle body 70. These bands are heated by torches 78*a* and 78*b*, the latter being an "assist torch" used to reduce the time required to heat the nozzle body 70. These copper alloy bands 76*a* and 76*b* are connected to copper alloy interconnecting channels 80. An insulating sleeve 82 covers approximately half of nozzle body 70, leaving copper alloy bands 76 exposed to torches 78*a* and 78*b***.

Figure 7:
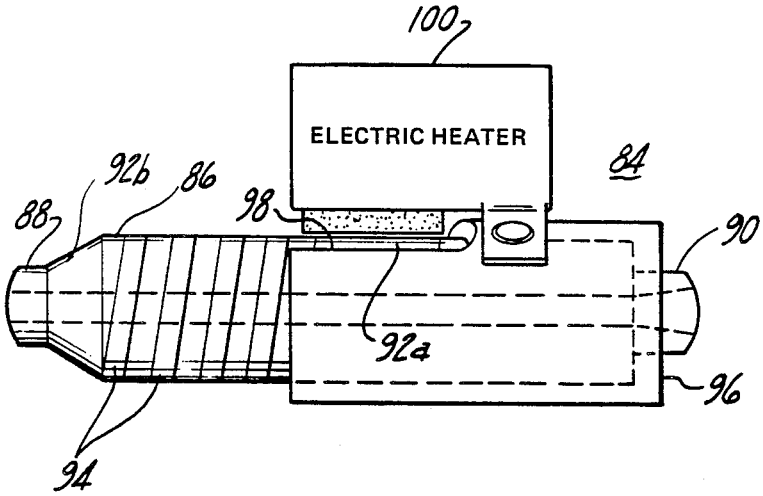
FIG. 7 is a sideview of the nozzle in FIG. 6 with the addition of an electric cartridge or band heater and an insulator integrated with said heater.

Referring to FIG. 7, an alternative embodiment of the invention is shown to comprise a nozzle 84 having a steel body 86 with ends 88 and 90 identical to ends 72 and 74 respectively in FIG. 6. Copper alloy bands **92*a* and 92*b* are identical to copper alloy bands 76*a* and 76*b* in FIG. 6, and are connected to copper alloy interconnecting channels 94. An insulating sleeve 96 covers approximately half of nozzle body 86 and extends just beyond copper alloy band 92*a*. This insulating sleeve 96 provides an opening 98 to permit electric cartridge heater 100 to come in contact with copper alloy band 92*a***.

The foregoing descriptions of specific embodiments intended to convey the fact that the invention can be embodied in a nozzle system used in the casting or molding of molten materials, such as zinc or zinc alloys, which employs a network of interconnecting copper channels, whether spirals, bands, coils, or any other pattern or design, these being heated by a concentrated source of heat to maintain the nozzle body at a desired temperature while molten materials are passing through the nozzle. The subject nozzle may, of course, be used as a conduit for any molten metal or metal alloy. In the following description, I intend to illustrate the application of the invention to nozzles which are typically smaller in length and diameter than those previously described and in which the tip is reinforced for additional durability by the addition of a hardened steel insert.

Figure 8:
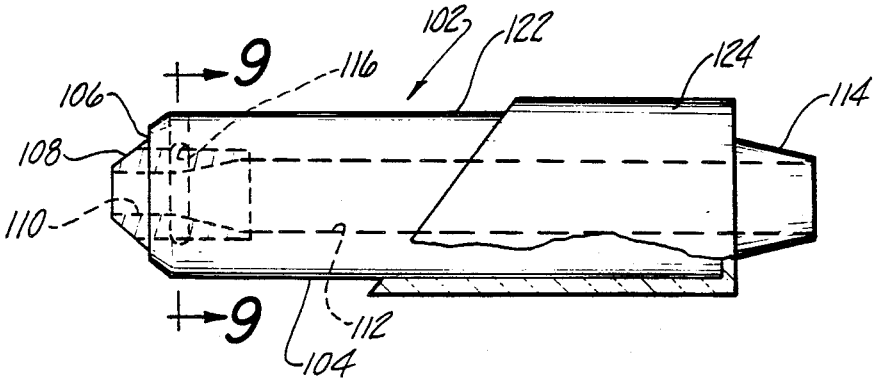
FIG. 8 is a side view of a nozzle having a hardened steel insert and incorporating the invention.
Figure 9:
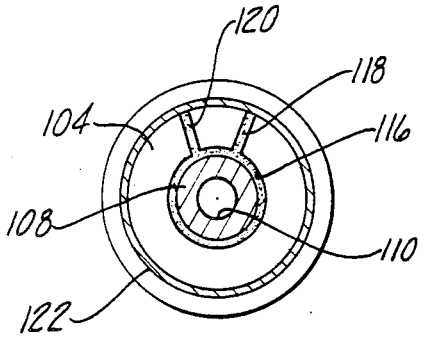
FIG. 9 is a sectional view of the device of FIG. 8 along section line 9—9.

Referring to FIGS. 8 and 9, the final embodiment of the invention comprises a nozzle 102 which is especially adapted or suitable for use in a zinc die cast machine of a type popular in the United States. Such machines require a nozzle which is separated from the die or which breaks away from the die after each injection of molten material; i.e. typically the nozzle is stationary but the die is arranged so as to be capable of moving away from the nozzle after the injection or shot.

The repetitive making and breaking of the connection between the nozzle and the die is particularly hard on the soft steel tip of the more conventional die. It is with this problem in mind that the embodiment of FIGS. 8 and 9 was conceived.

Nozzle 102 comprises a relatively soft steel body 104 having a tapered die end 106 into which a substantially cylindrical hardened steel insert 108 is placed. The insert 108 has a through-bore 110 which is connected with the through-bore 112 of the nozzle body 104. The through-bore 112 extends through a tapered gooseneck end 114 which is adapted to be connected to a source of molten material.

In accordance with the invention, the die and 106 of the nozzle body 104 is first hollowed out in a cylindrical fashion and then the inner surface of the cylindrical hollow is machined out or otherwise reformed to generate an annular channel or groove 116. Thereafter two annularly spaced holes 118 and 120 are drilled or otherwise formed through the nozzle body from the outer cylindrical surface thereof to the channel 116 as best shown in FIG. 9. Next, the hardened steel insert 108 is forced fit into place and high heat conductivity silver solder poured into the hole 118 so as to fully fill the channel 116; the hole 120 is used to vent the void formed by the channel 116 as it is filled with the silver solder. The solder tends to seep into and fill any void between the insert 108 and the hollowed interior surface of the nozzle body 104 and cement the nozzle insert 108 in place.

Thereafter a solid copper jacket 122 is placed over the nozzle body 104 and the lefthand end thereof as seen in FIG. 8 is crimped or bent down over the tapered surface 106 of the die end of the nozzle body 104. Jacket 122 is to some extent a substitute for the spiral copper filled channels of the previous embodiments, such channels being impractical in the embodiment of FIGS. 8 and 9 because of its reduced size. It will be apparent that jacket 122 is thermally connected to the annular band of silver solder in the channel 116 by way of the connector holes 118 and 120 which are also filled with thermally conductive silver solder. Accordingly, heat from a source which is trained upon the jacket 122 reaches the outer annular surface of the insert 108 and maintains the insert in a thoroughly heated condition so that no frething of the casting material occurs in or around the insert area.

Finally, if desired, a ceramic insulator 124 which covers only a portion of the jacket 122 is placed on the nozzle 102 in the manner shown in the drawings and the devices thereafter are ready for use in the fashion previously described.

Having described my invention with reference to several illustrative embodiments thereof I wish to advise the reader that the invention is not limited to any of the specific illustrated embodiments but, as will be apparent to those skilled in the art, is susceptible of a variety of other implementations.

I claim:

1. A casting nozzle for transferring molten metals into a die comprising:

a substantially solid nozzle body formed of a structural metal such as steel, having an inlet out and an outlet end and a through-bore between said ends;

said body having an external surface of area substantially greater than the surface area of said through-bore;

a relatively shallow groove formed in said exterior surface in a pattern which extends both circumferentially and axially of said body, substantially full between said ends but occupying only a portion of said surface area, thereby to define ungrooved land areas over said external surface; and a high heat conductivity metal such as copper filling said groove substantially flush with said surface to leave said land areas exposed;

said high heat conductivity metal serving as a passive heat transfer distribution path for heat applied locally to a portion of said nozzle body.

2. A casting nozzle as defined in claim 1 wherein said high heat conductivity metal is brazed to said body.

3. A casting nozzle as defined in claim 1 wherein said high heat conductivity metal is welded to said nozzle body.

4. A casting nozzle as defined in claim 1 wherein said pattern is substantially helical between the ends of said body.

5. A casting nozzle as defined in claim 4 wherein said pattern includes an annular band contiguous and integral with said helical portion.

6. A casting nozzle as defined in claim 1 wherein said groove is on the order of one-quarter inch in depth.

7. A casting nozzle as defined in claim 1 further including in combination a high temperature gas torch as a source of heat for said localized portion of said body, the flame of said torch being proximate and directed upon saaid nozzle body at a point adjacent said outlet end.

* * * * *